US007762070B2

(12) United States Patent
Dawson et al.

(10) Patent No.: US 7,762,070 B2
(45) Date of Patent: Jul. 27, 2010

(54) PILOT NOZZLE HEAT SHIELD HAVING INTERNAL TURBULATORS

(75) Inventors: Robert W. Dawson, Oviedo, FL (US); Richard E. King, Jr., Summerville, SC (US); Raman Ras, North Charleston, SC (US); Richard L. Sanford, North Charleston, SC (US)

(73) Assignee: Siemens Energy, Inc., Orlando, FL (US)

( * ) Notice: Subject to any disclaimer, the term of this patent is extended or adjusted under 35 U.S.C. 154(b) by 1035 days.

(21) Appl. No.: 11/432,591

(22) Filed: May 11, 2006

(65) Prior Publication Data

US 2010/0095677 A1 Apr. 22, 2010

(51) Int. Cl.
*F02C 7/22* (2006.01)

(52) U.S. Cl. ..... 60/740; 239/132

(58) Field of Classification Search ..... 60/740–743, 60/747, 752; 239/105, 132, 132.1, 132.3, 239/288

See application file for complete search history.

(56) References Cited

U.S. PATENT DOCUMENTS 4,070,826 A * 1/1978 Stenger et al. ..... 60/748
4,241,586 A 12/1980 Caruel et al.
4,914,918 A * 4/1990 Sullivan ..... 60/756
5,423,368 A 6/1995 Fitts et al.
5,467,926 A 11/1995 Idleman et al.
5,630,319 A 5/1997 Schilling et al.
6,282,905 B1 9/2001 Sato et al.
6,460,326 B2 10/2002 Bechtel et al.
2001/0022088 A1 9/2001 Mandai et al.
2003/0000217 A1 1/2003 North et al.
2003/0110774 A1 6/2003 Saitoh
2003/0221429 A1 12/2003 Laing et al.
2004/0045296 A1 3/2004 Wiebe et al.
2004/0055306 A1 3/2004 North et al.
2004/0079082 A1 4/2004 Bunker
2004/0083735 A1 5/2004 Borns et al.
2004/0148937 A1 8/2004 Mancini
2006/0027232 A1 * 2/2006 Parker et al. ..... 126/349
2007/0068164 A1 * 3/2007 Hernandez et al. ..... 60/740

* cited by examiner

*Primary Examiner*—Michael Cuff
*Assistant Examiner*—Phutthiwat Wongwian

(57) ABSTRACT

A pilot nozzle heat shield includes a body having a first end for receiving a pilot nozzle and a second end including a flow tip. The body includes a plurality of internal turbulators circumferentially disposed about the internal peripheral surface of the body. The flow tip includes a proximal periphery and a distal periphery. A plurality of flow ports are circumferentially spaced about the proximal periphery of the flow tip. The flow tip includes a plurality of slots. Each slot extends distally from one of the flow ports to the distal periphery of the flow tip, which defines an aperture. The plurality of slots define a plurality of tangs; each tang is defined between a pair of neighboring slots. A plurality of turbulators can be disposed about the inner peripheral surface of the heat shield body at the tangs.

20 Claims, 7 Drawing Sheets

PILOT NOZZLE HEAT SHIELD HAVING INTERNAL TURBULATORS

FIELD OF THE INVENTION

The invention relates in general to turbine engines and, more particularly, to heat shields for pilot nozzles.

BACKGROUND OF THE INVENTION

Combustion flame in the combustion chamber of a turbine engine is facilitated by a series of pilot nozzles that supply fuel under pressure to the combustion chamber. Because they are exposed to the volatile environment of the combustion chamber (i.e. extreme heat, pressure and vibration), unprotected pilot nozzles can become warped or clogged and the fuel passing therethrough can coke, which can cause a dramatic decrease in the operational efficiency of the pilot nozzle as well as the combustion facilitated thereby. Inefficient combustion can lead to greater fuel consumption, a loss in the amount of power the turbine produces and/or an increase in nitrogen oxide emissions, all of which can significantly increase operating costs.

There have been many efforts directed to protecting the pilot nozzles from the harsh operational environment of a turbine engine. One general approach to protect pilot nozzles has included reducing the amount of heat to which pilot nozzles tips are subjected. For instance, water jackets or heat shields have been provided to protectively surround the pilot nozzle. The heat shields are generally cylindrical with a conical end. While such heat shields provide some degree of protection, a number of problems have been experienced with their use, including fuel flow obstruction and air flow obstruction.

Some heat shields have been reconfigured to minimize these problems. For instance, the conical end of the heat shield has been slotted to form a plurality of separated tangs, which can provide sufficient heat resistance. Such heat shields can result in extended part life and in the preservation of the intended functionality or performance. While an improvement over other prior heat shield designs, the generally cylindrical, tanged heat shields can suffer from a number of problems. For example, the tanged heat shields have a smooth inner peripheral surface. Thus, when cooling air is supplied in the space between the pilot nozzle and the surrounding inner peripheral surface, the flow of the cooling air remains substantially uninterrupted along the inner peripheral surface. Such uninterrupted flow can result in inadequate cooling under some operating conditions. Inadequate cooling can potentially lead to some of the same problems associated with prior heat shield designs, including a decrease in component life and engine performance. Thus, there is a need for a heat shield design that can minimize such concerns.

SUMMARY OF THE INVENTION

Aspects of the invention are directed to a pilot nozzle heat shield. The heat shield has a body with a first end region that includes a first end. The body also has a second end region that includes a second end opposite the first end. The body has a longitudinal axis that extends from the first end to the second end. The body has an internal cavity that opens to the first end in which a pilot nozzle can be received. The internal cavity can have an internal taper to aid in receiving the pilot nozzle. The heat shield body has an inner peripheral surface and an outer peripheral surface.

The heat shield can be made of a heat resistant weldable alloy. In one embodiment, such an alloy can include iron and at least two of the following materials: aluminum, boron, carbon, chromium, cobalt, copper, manganese, molybdenum, nickel, phosphorus, silicon, sulfur, titanium or tungsten. The heat shield body can include a plurality of retention pin passages. Retention pins can be inserted into these cavities and engage the pilot nozzle so as to maintain the position of the heat shield around the pilot nozzle. The retention pin passages can be reinforced by a heat resistant alloy material disposed about the periphery of the heat shield.

The second end region includes a flow tip. The flow tip extends from a proximal periphery to a distal periphery, which defines an aperture. A plurality of flow ports extend through the heat shield body and are spaced about the proximal periphery of the flow tip. The flow tip further includes a plurality of through slots.

Each through slot extends distally from one of the plurality of flow ports to the aperture. The through slots define tangs therebetween. In one embodiment, the tangs can angle concentrically inward at an angle between about 25 degrees and about 90 degrees relative to the longitudinal axis of the heat shield body. More particularly, the tangs can angle concentrically inward at an angle between about 25 degrees and about 65 degrees relative to the longitudinal axis of the heat shield body.

One or more internal turbulators are disposed on the inner peripheral surface of the body. The turbulators are located proximate and upstream of the flow tip. In one embodiment, one or more tang turbulators can be disposed about the inner peripheral surface of the heat shield body located at the tangs.

Another pilot nozzle heat shield for use in a gas turbine engine according to aspects of the invention includes a generally cylindrical body that has a first end region that includes a first end for receiving a pilot nozzle. The body also has a second end region that includes a second opposite end. The body has a longitudinal axis that extends from the first end to the second end. The heat shield body has an inner peripheral surface and a outer peripheral surface. The body further includes one or more internal turbulators disposed circumferentially about the internal peripheral surface of the body. These turbulators can promote mixing of cooling air passing along the inner peripheral surface of the body.

The heat shield body is made of a heat resistant weldable alloy. Such an alloy can include iron and at least two other materials selected from the following group: aluminum, boron, carbon, chromium, cobalt, copper, manganese, molybdenum, nickel, phosphorus, silicon, sulfur, titanium and tungsten. The heat shield can include at least three retention pin passages. The retention pin passages can be reinforced by an annular ring of heat resistant alloy material disposed about the periphery of the heat shield.

The second end region of the body includes a frustoconical flow tip. The flow tip has a proximal periphery and a distal periphery that defines an aperture. A plurality of flow ports extend through the body and are circumferentially disposed about the proximal periphery of the flow tip. The flow tip includes a plurality of slots therein. Each slot extends distally from one of the flow ports to the aperture. A tang is defined between each pair of slots. At least two tangs are provided on the flow tip. The tangs can angle concentrically inward at an angle between about 25 degrees and about 65 degrees relative to the longitudinal axis of the heat shield body. In one embodiment, the heat shield body can further include one or more tang turbulators disposed about the inner peripheral surface of the heat shield body located at the tangs.

In another respect, aspects of the invention relate to a pilot nozzle system for use in a gas turbine engine. The system includes a pilot nozzle that has a distal end. The pilot nozzle includes a plurality of castellations proximate the distal end. The system further includes a heat shield that has a body with a first end region including a first end and a second end region including a second opposite end. The body has a longitudinal axis that extends from the first end to the second end. The heat shield body has an inner peripheral surface and an outer peripheral surface. The inner peripheral surface can enclose an inner cavity. At least a portion of the pilot nozzle including the distal end can extend into the inner cavity of the heat shield body. For instance, the pilot nozzle can extend into the internal cavity from the first end of the heat shield body. Once inside the cavity, the distal end of the pilot nozzle can be located near the second end of the heat shield body.

The body can be made of a heat resistant weldable alloy. The alloy can include iron and at least two other materials from the following group: aluminum, boron, carbon, chromium, cobalt, copper, manganese, molybdenum, nickel, phosphorus, silicon, sulfur, titanium and tungsten.

The body further includes one or more internal turbulators disposed circumferentially about the internal peripheral surface of the body. These internal turbulators can promote mixing cooling air passing over the inner peripheral surface of the body.

The second end region of the body includes a frustoconical flow tip. The flow tip extends from a proximal periphery to a distal periphery, which defines an aperture. The flow tip includes a plurality of slots. Each slot extends distally from one of the flow ports circumferentially disposed about the proximal periphery of the frustoconical flow tip to the aperture. Tangs are defined between each pair of slots. Two or more tangs can be provided on the flow tip. The tangs can angle concentrically inward at an angle between about 25 degrees and about 65 degrees relative to the longitudinal axis of the heat shield. According to aspects of the invention, the heat shield body can further include one or more tang turbulators disposed about the inner peripheral surface of the heat shield body located at the tangs.

The castellations can have an associated radial height, and the pilot nozzle can have an associated nozzle thickness. The ratio of the radial height to the nozzle thickness can be in the range of about 0.25 to about 0.75. In one embodiment, the ratio of radial height to nozzle thickness can be about 0.5. Alternatively or in addition, The castellations can have an associated wall thickness, and the fuel jet can have an associated jet diameter. The ratio of the wall thickness to the jet diameter can be in the range of about 0.25 to about 5.0. In one embodiment, the ratio of the wall thickness to the jet diameter can be about 1:1. Such sizing and configuring of the castellations can facilitate the disruption fluid flow over the castellations so as to effectively cool the heat shield in a region proximate the nozzle distal end, while maintaining structural integrity of the flow jets.

DETAILED DESCRIPTION OF EMBODIMENTS OF THE INVENTION

Aspects of the invention are directed to a pilot nozzle heat shield with internal turbulators to facilitate cooling of the pilot nozzle heat shield. Embodiments of the invention will be explained in connection with one possible heat shield system, but the detailed description is intended only as exemplary. Embodiments of the invention are shown in FIGS. 1-7, but the present invention is not limited to the illustrated structure or application.

Figure 1:
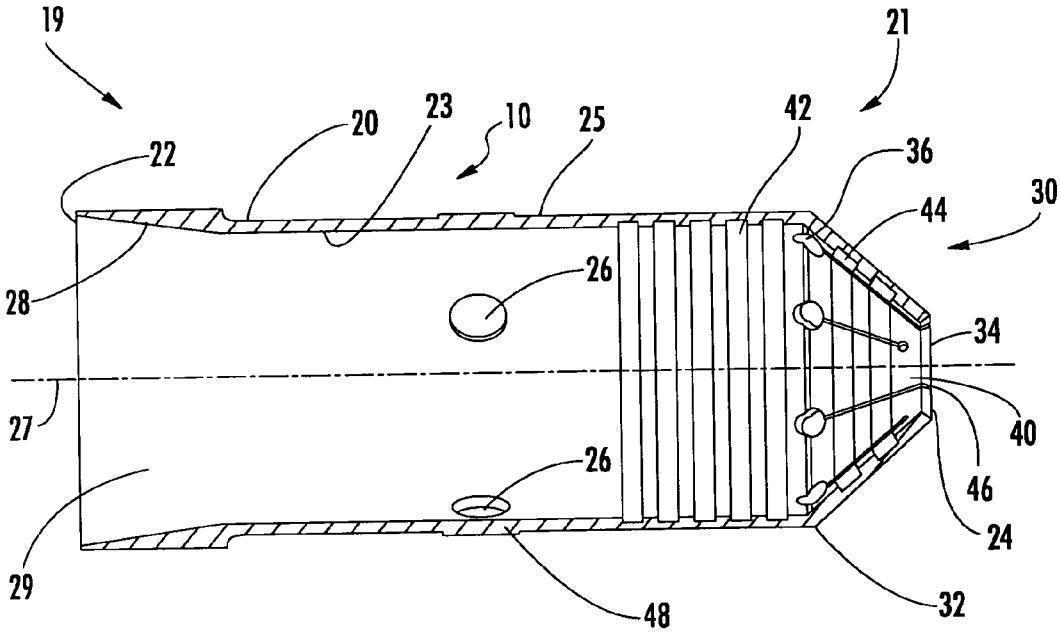
FIG. 1 is a cross-sectional side view of a pilot nozzle heat shield according to aspects of the invention.
Figure 2:
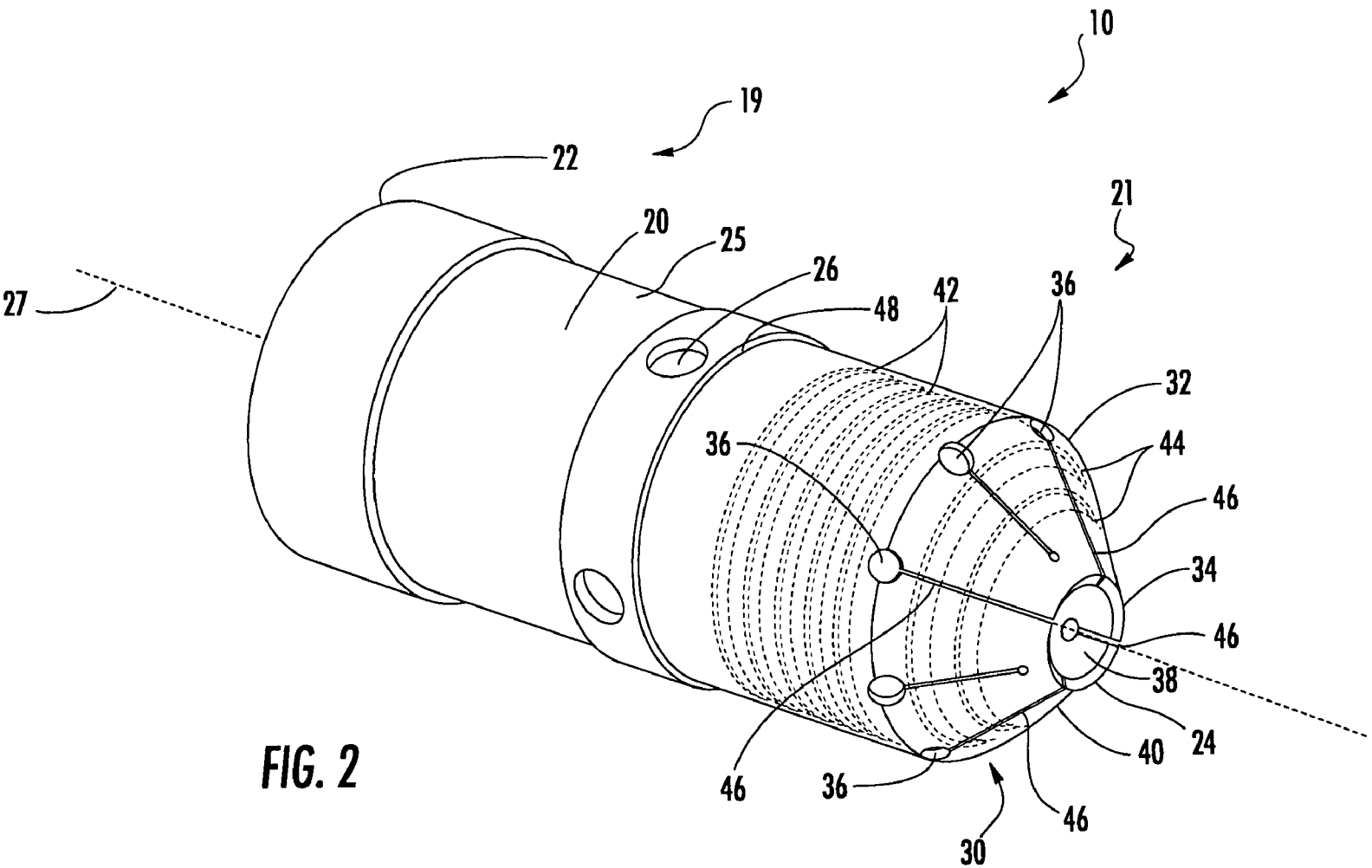
FIG. 2 is a perspective view of a pilot nozzle heat shield according to aspects of the invention with a phantom internal view illustrating the internal turbulators inside the heat shield.

Referring to FIGS. 1-2, a pilot nozzle heat shield 10 according to aspects of the invention can have a body 20, which can be generally cylindrical in conformation. The body 20 can have a first end region 19 including a first end 22 and a second end region 21 including a second end 24. The body 20 can be hollow so that an inner cavity 29 is formed in the pilot nozzle heat shield 10. The body 20 can further include an inner peripheral surface 23 and an outer peripheral surface 25. The pilot nozzle heat shield 10 can have a longitudinal axis 27.

The heat shield 10 can be formed in any suitable way. For instance, the heat shield 10 can be milled or otherwise machined from a block of material. Alternatively, the heat shield can be formed by casting. The heat shield 10 can be made of any suitable material. In one embodiment, the heat shield 10 can be made of a highly heat resistant alloy or other similar material. For example, the heat shield can be made of Hastelloy X, Altemp HX, Nickelvac HX, Nicrofer 4722 Co, Pyromet Alloy 680 or any other alloy having iron and at least two other elements selected from the group consisting of aluminum, boron, carbon, chromium, cobalt, copper, manganese, molybdenum, nickel, phosphorus, silicon, sulfur, titanium, and tungsten.

A portion of the inner peripheral surface 23 of the body 20 proximate the first end 22 can have an internal taper 28. The second end region 21 of the body 20 of the heat shield 10 can include a flow tip 30. The flow tip 30 can be a generally cylindrical cone, tapering from a proximal periphery 32 at a first diameter to a distal periphery 34 at a second, smaller diameter. A plurality flow ports 36 can extend substantially radially through the body 20 at or near the proximal periphery 32. The flow ports 36 can extend substantially radially relative to the longitudinal axis 27 of the body 20. The flow ports 36 can be spaced about the body 20 in the peripheral direction. In one embodiment, the flow ports 36 can be substantially equally spaced. The term "flow port" as used herein is defined as a hole, passage or opening located at or near the proximal periphery 32 of the flow tip 30, through which air and/or fuel can pass. The flow ports 36 can have a circular cross-sectional shape, but they can have any suitable cross-sectional shape.

The flow tip 30 can further include a plurality of through slots 46. Each slot 46 can extend from one of the flow ports 36 to the distal periphery 34 of the flow tip 30 so as to form a plurality of tangs 40. The tangs 40 can angle substantially concentrically inward from the proximal periphery 32 to the distal periphery 34 so as to form the flow tip 30. In one embodiment, the flow tip 30 can be frustoconical in shape. The tangs 40 can extend at an suitable angle relative to the flow tip. For example, the tangs 40 can extend between about 25 degrees and about 90 degrees relative to the longitudinal axis 27. More particularly, the tangs 40 can extend between about 25 degrees and about 65 degrees relative to the longitudinal axis 27. The tangs 40 can terminate at the distal periphery 34 of the flow tip 30. The ends of the tangs 40 can collectively define an aperture 38 in the second end 24 of the heat shield 10, through which air and pilot fuel can exit during engine operation.

According to aspects of the invention, one or more turbulators 42 can be disposed about the inner peripheral surface 23 of the heat shield 10 proximate the flow tip 30 and upstream of the fuel ports 36. The turbulators 42 can take any suitable form. In one embodiment, each internal turbulator 42 can be a circumferential channel, which can be formed in the inner peripheral surface 23 of the heat shield body 20 by milling or other suitable process. In another embodiment, the turbulator 42 can be formed by attaching a band of additional material to the inner peripheral surface 23 of the heat shield body 20. The turbulator 42 can be any suitable structure that can cause a disruption in the air flow through the heat shield 10.

In addition to the turbulators 42 disposed about the internal periphery of the heat shield body 20, the heat shield 10 can also include one or more tang turbulators 44 disposed about the internal peripheral surface 23 in the region of the tangs 40. The tang turbulators 44 can likewise be formed, for example, as milled circumferential channels or raised bands of additional material. The tang turbulators 44 can be any suitable structure that can cause a disruption in the flow of air passing through the heat shield 10 so as to cause a mixing effect on the air flowing therethrough. The tang turbulators 44 can extend substantially circumferentially about the inner peripheral surface 23 of the tangs 40.

Figure 3:
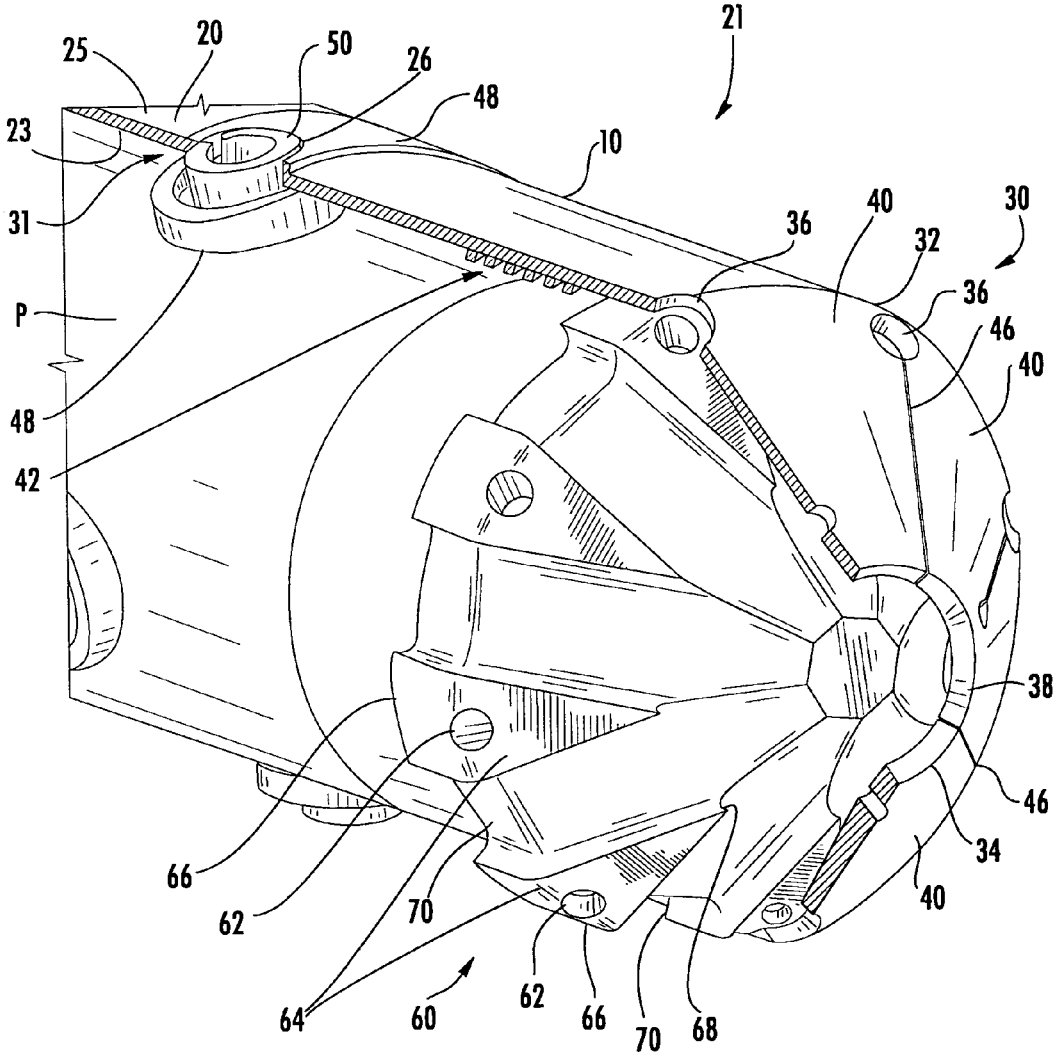
FIG. 3 is a cutaway perspective view of a pilot nozzle heat shield and a gas only pilot nozzle assembly according to aspects of the invention.
Figure 4:
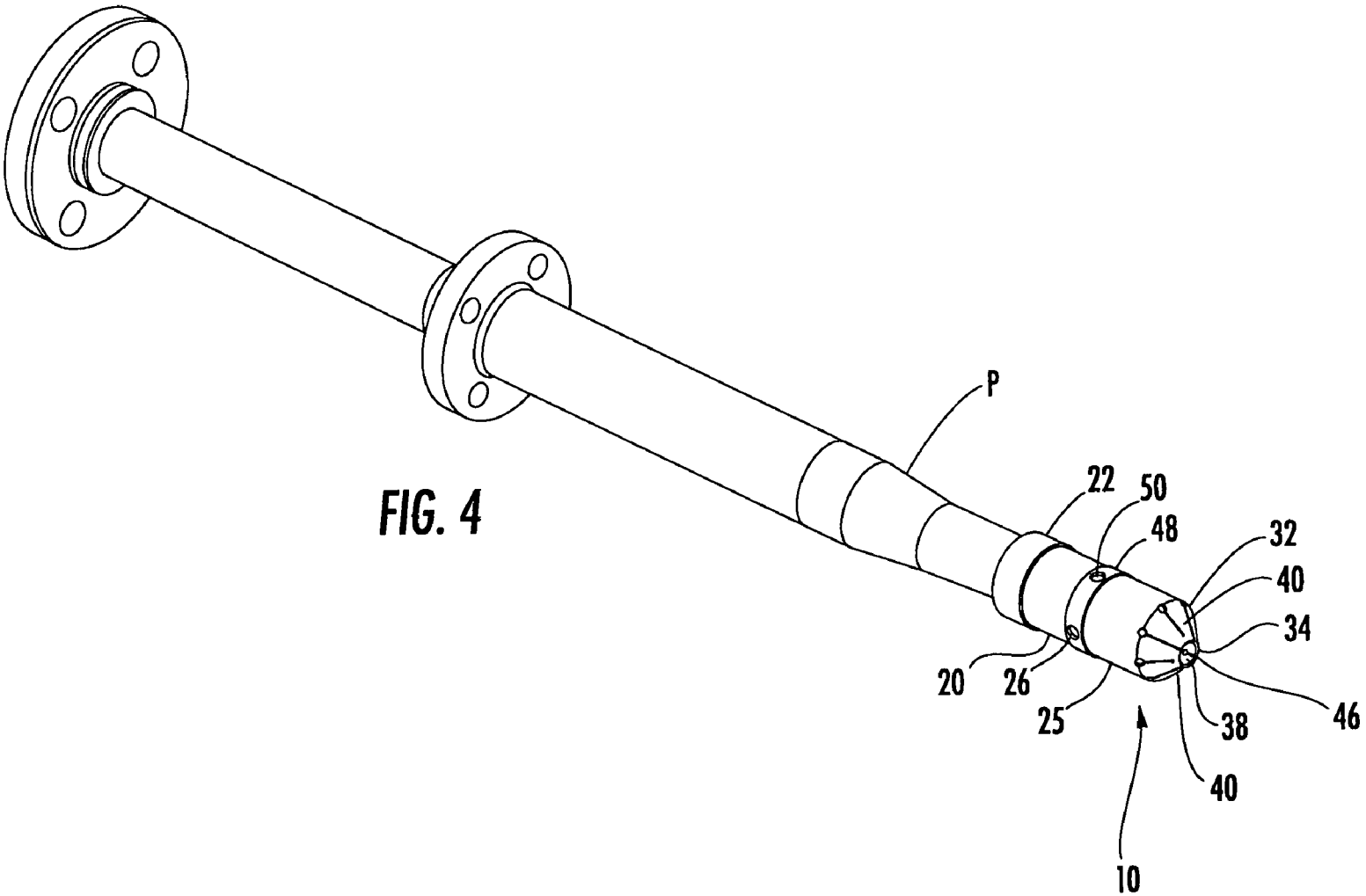
FIG. 4 is a perspective view of a pilot nozzle heat shield and a gas-only pilot nozzle assembly according to aspects of the invention.
Figure 5:
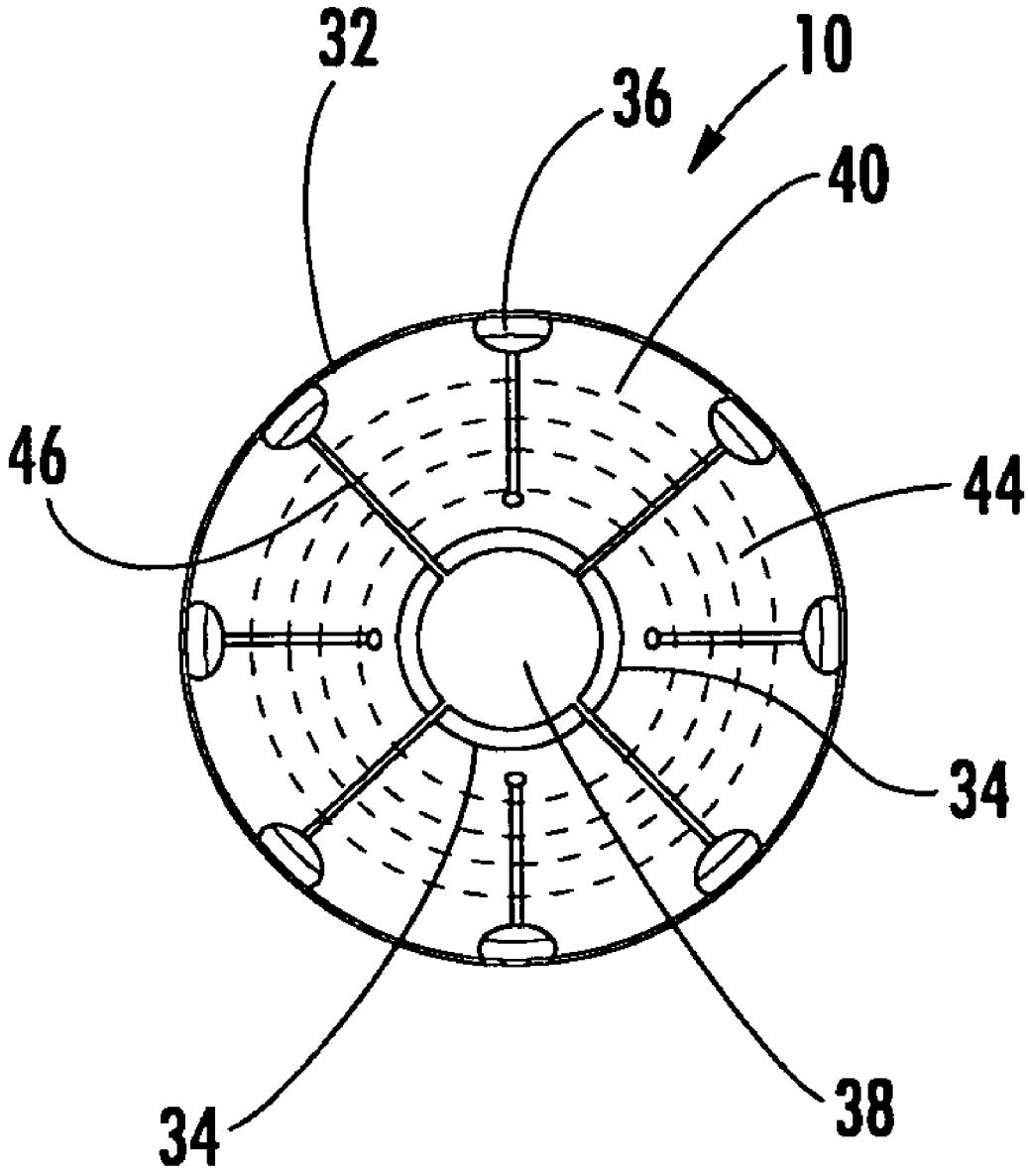
FIG. 5 is a front elevation view of a pilot nozzle heat shield according to aspects of the invention.
Figure 6:
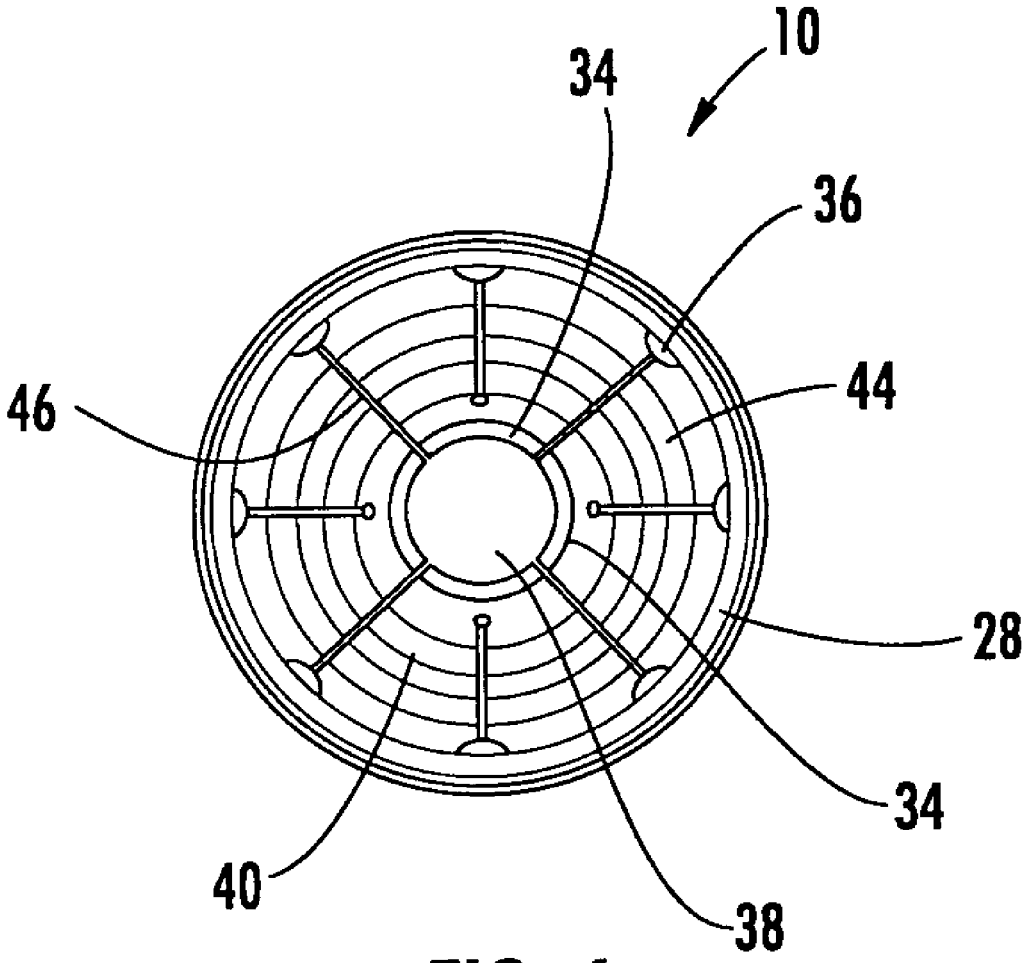
FIG. 6 is a rear elevation view of a pilot nozzle heat shield according to aspects of the invention.

Referring to FIG. 3, a pilot nozzle P can be inserted into the cavity 29 of the heat shield body 20 from the open first end 22. The heat shield 10 is preferably held in place on the pilot nozzle P by the retention pins 50. A series of retention pin passages 26 can extend substantially radially (relative to the longitudinal axis 27) through the heat shield body 20 in an area located between the first end region 22 and the second end region 24. The passages 26 can be substantially circumferentially spaced and aligned about the body 20. Preferably, each of the retention pin passages 26 is sufficiently size to receive a retention pin 50. The retention pins 50 can be manufactured from a weldable material, such as stainless steel or the same or a similar material to that from which the heat shield 10 is manufactured. The retention pins 50 can be any type of pin manufactured from a weldable material with sufficient strength to maintain position of the heat shield around the pilot nozzle P. In one embodiment, the retention pins 50 can be 300 series stainless steel split-pins.

The retention pins 50 can be held in place by any suitable means so that the vibration forces in the combustion chamber (not shown) do not jar the heat shield 10 loose from the pilot nozzle P. For example, the retention pins 50 can be attached directly to the body 20 of the heat shield 10, such as by welding the retention pins 50 to the body 20 of the heat shield 10 at the retention pin passages 26. In such case, the retention pins 50 must be milled or ground out of the body 20 in order to replace the retention pins 50 or the heat shield 10.

Because the retention pins 50 are used to maintain the position of the heat shield 10 around the pilot nozzle P, they are preferably mounted in a manner to provide sufficient structural strength and maintain the integrity and position of the heat shield 10. A reinforcing ring can be used to provide additional strength to the retention pins 50 mounted in the body 20 of the heat shield 10. For example, an annular ring 48 can be formed with or attached to the inner peripheral surface 23 and/or the outer peripheral surface 25 of the heat shield 10. Such a ring 48 can be extend circumferentially about the heat shield body 20 or can be provided at the locations of the retention pin passages 26. Alternatively, a plurality of annular rings 48 can be formed with or attached to the pilot nozzle P such that they align at the locations of the retention pin passages 26 in the heat shield 10. The annular ring 48 can have a passage to receive a portion of the retention pins 50. The annular ring 48 can be formed using any suitable process, including, for example, milling, welding or casting. In one embodiment, the annular ring 48 can be made of a weldable heat resistant material.

When the pilot nozzle P is received in the heat shield body 20, there can be a space 31 between the inner periphery surface 23 of the body 20 and the pilot nozzle P. The body 20 can be sufficiently sized to allow sufficient airflow in the space 31. The first end region 22 of the body 20 can have an internal taper 28 to facilitate air flow through the space 31 between the pilot nozzle P and the heat shield 10. In operation, the heat shield 10 can be the main source of heat protection for the pilot nozzle P.

During operation, cooling air is supplied to and flows along the space 31 between the heat shield 10 and the pilot nozzle P from the first end region 19 toward the second end region 21. As it flows along the space 31, the air will initially encounter the internal turbulators 42. The ridges on the internal turbulators 42 cause a disruption in the air flow across the internal peripheral surface 23 of the heat shield 10. The interrupted flow of air causes newly introduced air to mix with existing air, resulting in a more efficient heat exchange. This heat exchange results in a cooling effect on both the pilot nozzle P and the heat shield 10. The mixed air can exit the heat shield 10 through the aperture 38. Downstream of the internal turbulators 42, the tang turbulators 44 can cause additional disruption of the airflow, resulting in a greater cooling effect.

In addition to cooling the pilot nozzle P, the air flowing through the heat shield 10 can decrease the temperature of the heat shield 10 and thereby act as an additional buffer between the heat shield 10 and the pilot nozzle P. The cooling of the heat shield 10 can significantly reduce the amount of damage caused by the intense heat in the combustion chamber thereby increasing the usable life of the heat shield 10, in addition to preventing fuel coking and clogging of the pilot nozzle P.

Due to the location of the retention pins 50, there is generally an inherent obstruction of the air flow in the space 31 between the heat shield 10 and the pilot nozzle P. Accordingly, it is preferable to keep the number of retention pins 50 to a minimum to reduce such airflow obstructions, while maintaining the heat shield 10 in the proper position around the pilot nozzle P. While the heat shield 10 can be retained by as few as two opposing retention pins 50, the vibrational forces in the combustion chamber can cause the heat shield 10 to pivot about the axis of the two opposing retention pins 50, thereby causing further obstruction of the airflow through the heat shield 10 and resulting in an inefficient pilot burn. Therefore, it is preferred if there are at least three retention pins 50. In one embodiment, there can be four retention pins 50.

Figure 7:
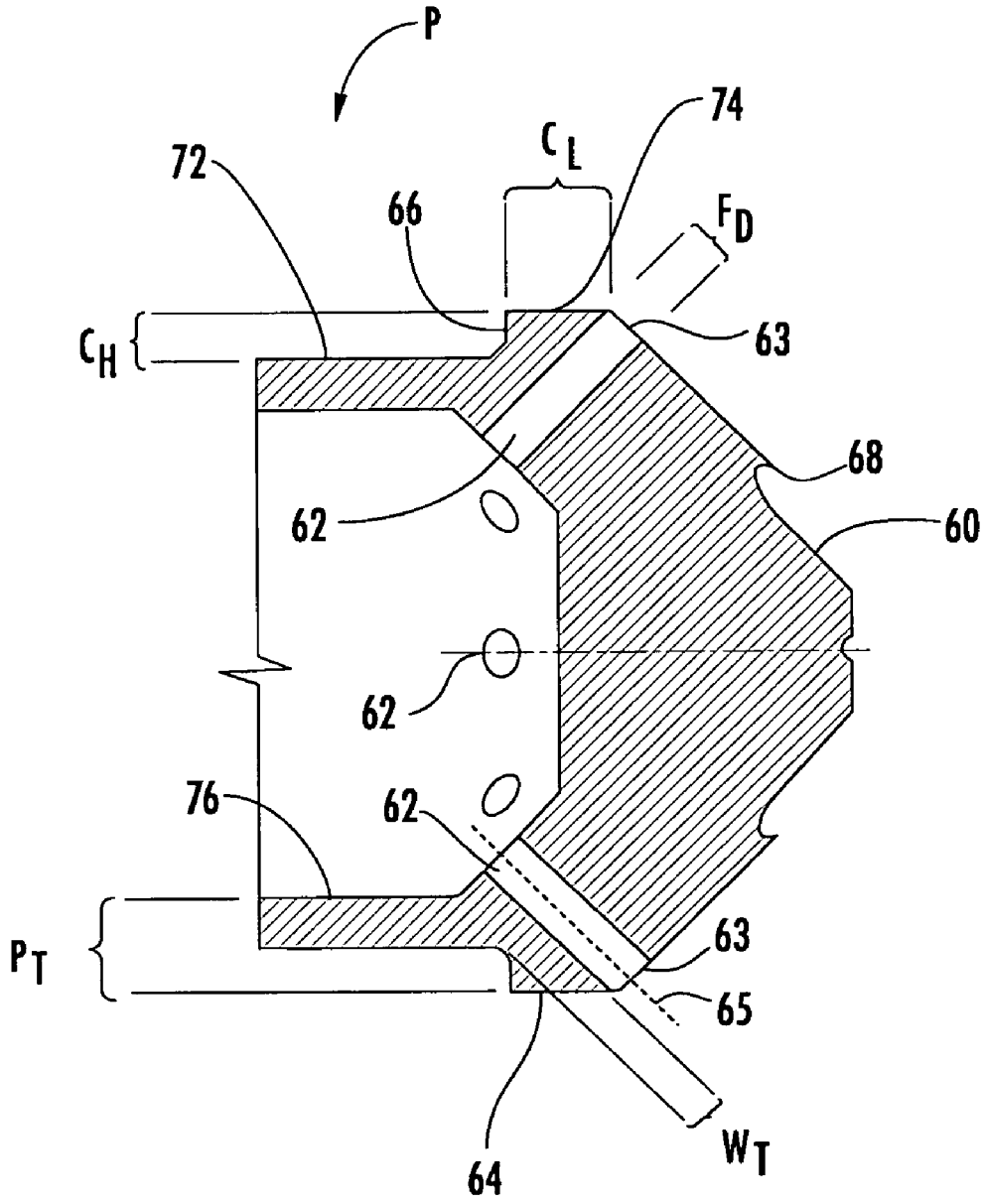
FIG. 7 is a cross-sectional side view of a pilot nozzle with castellations according to aspects of the present invention.

Referring now to FIGS. 3 and 7, the pilot nozzle P can include an end region 60 having a plurality of fuel jets 62. The fuel jets 62 can be open jets flush with the end region 60 of the pilot nozzle P or can be disposed in a castellation 64 extending from the pilot nozzle P at or near the end region 60. Each flow port 36 of the heat shield 10 can be aligned with a respective one of the fuel jets 62 on the end region 60 of the pilot nozzle P. Such placement of the flow ports 36 allows for the pilot fuel to exit the fuel jets 62 and pass through an associated flow port 36, where it is ignited in the combustion chamber.

The castellations 64 of the pilot nozzle P can be located on or near the end region 60 of the pilot nozzle P. The castellations 64 can serve to provide support for the heat shield 10 as well as provide additional airflow disruption through the heat shield 10. As the airflow is disrupted by the castellations 64, the air flowing between the pilot nozzle P and heat shield resulting in a more efficient cooling effect on the heat shield 10 and nozzle end region 60.

The castellations 64 can comprise an upstream end 66 and a downstream end 68. The first upstream end 66 can comprise a blunt shape, round shape or any other shape sufficient to provide a disruption of air flowing through the heat shield 10. Flow channels 70 can be disposed between the castellations to allow air flow over the internal surface of the heat shield 10.

The castellations 64 can have an associated length $C_L$ defined between the upstream end 66 and an exit 63 of the fuel jet 62. The catellations 64 can also have an associated castellation height $C_H$ defined between an outer peripheral surface 72 of the pilot nozzle P and the radially outermost surface 74 of the castellation 64. According to aspects of the invention, the length of the castellations $C_L$ can be shortened longitudinally so that the castellation upstream end 66 is as close to the exit 63 of the fuel jet 62 as possible without diminishing the structural integrity of either the associated castellations 64 or fuel jets 62. The longitudinally shortened castellation 64 can be defined as a ratio between the castellation length $C_L$ and the castellation height $C_H$. One appropriate range of lengths for the castellation $C_L$ can be between about 0.75 and 5 times the height of the castellation $C_H$; however, it is noted that other lengths may also be suitable. In the present embodiment, it is preferred that the measurement of the castellation length $C_L$ to castellation height $C_H$ is approximately a 2:1 ratio. It is noted, however, that other ratios may also be suitable.

The pilot nozzle P can have an associated thickness PT defined between the inner peripheral surface 76 of the pilot nozzle P and the radially outermost surface of the castellation 74. One appropriate range for the castellation height $C_H$ is between about 0.25 and about 0.75 times the pilot nozzle thickness PT, and, preferably, the castellation height $C_H$ is about 0.5 times the pilot nozzle thickness PT. However, it is noted that other ratios may also be selected.

The castellations 64 can have an associated wall thickness $W_T$, which can be defined as the smallest thickness between the wall of the fuel jets 62 and the nearest outermost surface of the castellation 64, measured in a direction substantially transverse to the axis 65 of the fuel jets 62. To create a castellation 64 with the appropriate structural characteristics, the wall thickness $W_T$ of the castellation 64 can be made to be between about 0.25 to 5 times the fuel jet diameter $F_D$. It is preferred that the measurement of the fuel jet diameter $F_D$ to wall thickness $W_T$ is approximately a 1:1 ratio.

The following are examples illustrating procedures for practicing aspects of the invention. These examples should not be construed as limiting, but should include any and all obvious variations as would be readily apparent to a skilled artisan.

In a dual-fuel system, where oil is utilized to fuel the pilot flame, the heat shield 10 can be mounted to a pilot nozzle P using three or four retention pins 50. The pilot nozzle P comprises a fuel tip (not shown) that extends through and past the aperture 38 of the heat shield 10. During operation, pilot fuel, generally oil, is ignited at the fuel tip of the pilot nozzle P and air flows through the heat shield 10, passing over the turbulators 44, where it mixes the cooling air. The air operates to cool the pilot nozzle heat shield 10 and further operates to buffer the pilot nozzle P from excessive heat. The cooling air then exits the heat shield 10 through the flow ports 36 and the aperture 38.

In a gas-only turbine, the pilot nozzle heat shield 10 can be mounted to the pilot nozzle P using three or four retention pins 50. As pilot fuel exits the fuel jets 62 on the end region 60, it flows through the substantially aligned flow ports 36 located at the proximal periphery 32 of the flow tip 30 and ignites in the combustion chamber of the turbine (not shown). Air flows through the space 31 between the heat shield 10 and the pilot nozzle P, entering through the first end 22 of the body 20 of the heat shield 10. The air passes over the turbulators 42 where it mixes the cooling air and operates to more efficiently cool the pilot nozzle heat shield 10 and further operates to buffer the pilot nozzle P from excessive heat, while also providing additional cooling to the heat shield 10. Optionally, the heat shield 10 can comprise tang turbulators 44 disposed about the internal periphery of the tangs 40 to provide additional disruption of air flow resulting in a more efficient mixing of air and resulting cooling effect. In addition, the pilot nozzle P can comprise castellations 64 on the end region 60 of the pilot nozzle P to provide additional disruption of airflow, resulting in a more efficient mixing of air and resulting cooling effect. The used cooling air then exits the heat shield 10 through the aperture 38.

When used in accordance with the teachings set forth herein, the heat shield 10 can protect and maintain the integrity of the pilot nozzle, resulting in significant cost savings for users. Inasmuch as the preceding disclosure presents the best mode devised by the inventor for practicing the invention and is intended to enable one skilled in the pertinent art to carry it out, it is apparent that structures and methods incorporating modifications and variations will be obvious to those skilled in the art. As such, it should not be construed to be limited thereby but should include such aforementioned obvious variations and be limited only by the spirit and scope of the following claims.

What is claimed is:

1. A pilot nozzle heat shield comprising:

a heat shield body having a first end region including a first end and a second end region including a second opposite end, the body having an internal cavity opening to the first end for receiving a pilot nozzle, the heat shield body having an inner peripheral surface and an outer peripheral surface, wherein the body has a longitudinal axis extending from the first end to the second end;

the second end region including a flow tip, the flow tip extending from a proximal periphery to a distal periphery defining an aperture, a plurality of flow ports extending through the heat shield body and spaced about the proximal periphery of the flow tip, the flow tip further including a plurality of through slots, each through slot extending distally from one of the plurality of flow ports to the aperture, the through slots defining sets of tangs therebetween; and at least one internal turbulator disposed on the inner peripheral surface of the body, the internal turbulator being located proximate and upstream of the flow tip.

2. The pilot nozzle heat shield of claim 1 wherein the heat shield body further includes at least one tang turbulator disposed about the inner peripheral surface of the heat shield body located at the tangs.

3. The pilot nozzle heat shield of claim 1 wherein the heat shield is manufactured from a heat resistant weldable alloy that includes iron and at least two other materials selected from the group consisting of: aluminum, boron, carbon, chromium, cobalt, copper, manganese, molybdenum, nickel, phosphorus, silicon, sulfur, titanium and tungsten.

4. The pilot nozzle heat shield of claim 1 wherein the tangs angle concentrically inward at an angle between about 25 degrees and about 90 degrees relative to the longitudinal axis of the heat shield body.

5. The pilot nozzle heat shield of claim 1 wherein the tangs angle concentrically inward at an angle between about 25 degrees and about 65 degrees relative to the longitudinal axis of the heat shield body.

6. The pilot nozzle heat shield of claim 1 wherein the heat shield body includes a plurality of retention pin passages and wherein at least one of the retention pin passages is reinforced by a ring of a heat resistant alloy material disposed about the periphery of the heat shield.

7. The pilot nozzle heat shield of claim 1 wherein the first end region has an internal taper for receiving the pilot nozzle.

8. A pilot nozzle heat shield for use in a gas turbine engine comprising:

a generally cylindrical body having a first end region including a first end and a second end region including a second opposite end, wherein the body has a longitudinal axis extending from the first end to the second end, the heat shield body having an inner peripheral surface and a outer peripheral surface, the body being manufactured from a heat resistant weldable alloy, the body further comprising at least one internal turbulator disposed circumferentially about the internal peripheral surface of the body for mixing cooling air passing therethrough, the second end region of the body includes a frustoconical flow tip, the frustoconical flow tip comprising a proximal periphery and a distal periphery defining an aperture and further comprising a plurality of slots, each slot extending distally from one of a plurality of flow ports circumferentially disposed about the proximal periphery of the frustoconical flow tip to the aperture, the slots defining tangs therebetween, wherein at least two of the tangs are provided on the flow tip.

9. The pilot nozzle heat shield of claim 8 wherein the heat shield body further includes at least one tang turbulator disposed about the inner peripheral surface of the heat shield body located at the tangs.

10. The pilot nozzle heat shield of claim 8 wherein the heat resistant weldable alloy includes iron and at least two other materials selected from the group consisting of: aluminum; boron; carbon; chromium; cobalt; copper; manganese; molybdenum; nickel; phosphorus; silicon; sulfur; titanium; and tungsten.

11. The pilot nozzle heat shield of claim 8 wherein the tangs angle concentrically inward at an angle between about 25 degrees and about 65 degrees relative to the longitudinal axis of the heat shield body.

12. The pilot nozzle heat shield of claim 11 wherein the heat shield comprises between three and four retention pin passages and wherein the retention pin passages are reinforced by an annular ring of heat resistant alloy material disposed about the periphery of the heat shield.

13. A pilot nozzle for use in a gas turbine engine comprising:

a pilot nozzle having a distal end, the pilot nozzle including a plurality of castellations disposed proximate to the distal end; and a heat shield having body with a first end region including a first end and a second end region including an opposite second end, wherein the body has a longitudinal axis extending from the first end to the second end, the heat shield body having an inner peripheral surface and an outer peripheral surface, the body having an internal cavity opening to the first end, the body further comprising at least one internal turbulator disposed circumferentially about the internal peripheral surface of the body for mixing cooling air passing therethrough, the second end region of the body includes a frustoconical flow tip, the frustoconical flow tip having a proximal periphery and a distal periphery defining an aperture, the flow tip including a plurality of through slots, wherein each slot extends distally from one of a plurality of flow ports circumferentially disposed about the proximal periphery of the frustoconical flow tip to the aperture, the slots defining tangs therebetween, wherein at least two of the tangs are provided on the flow tip, wherein at least a portion of the pilot nozzle including the distal end extends into the internal cavity.

14. The pilot nozzle heat shield of claim 13 wherein the heat shield body further includes at least one tang turbulator disposed about the inner peripheral surface of the heat shield body located at the tangs.

15. The pilot nozzle of claim 13 wherein the tangs angle concentrically inward at an angle between about 25 degrees and about 65 degrees relative to the longitudinal axis of the heat shield.

16. The pilot nozzle of claim 13 wherein the heat shield is manufactured from a heat resistant weldable alloy including iron and at least two other materials selected from the group consisting of: aluminum, boron, carbon, chromium, cobalt, copper, manganese, molybdenum, nickel, phosphorus, silicon, sulfur, titanium and tungsten.

17. The pilot nozzle of claim 13 wherein at least one of the castellations is characterized by a radial height and the nozzle is characterized by a nozzle thickness, wherein the ratio of the radial height to the nozzle thickness is in the range of about 0.25 to about 0.75.

18. The pilot nozzle of claim 17, wherein the ratio of radial height to nozzle thickness is about 0.5.

19. The pilot nozzle of claim 13, wherein at least one of the castellations is characterized by a wall thickness and the fuel jet is characterized by a jet diameter, wherein the ratio of the wall thickness to the jet diameter is in the range of about 0.25 to about 5.0.

20. The pilot nozzle of claim 19, wherein the ratio of the wall thickness to the jet diameter is about 1:1.

* * * * *